US008302613B2

(12) United States Patent
Yde et al.

(10) Patent No.: US 8,302,613 B2
(45) Date of Patent: Nov. 6, 2012

(54) CONDITIONER APPLICATOR FOR HAIR STYLING DEVICE

(75) Inventors: Steve Yde, Sterling, IL (US); James E. McCambridge, Polo, IL (US)

(73) Assignee: Wahl Clipper Corporation, Sterling, IL (US)

( * ) Notice: Subject to any disclaimer, the term of this patent is extended or adjusted under 35 U.S.C. 154(b) by 743 days.

(21) Appl. No.: 12/113,741

(22) Filed: May 1, 2008

(65) Prior Publication Data

US 2009/0019719 A1 Jan. 22, 2009

Related U.S. Application Data

(60) Provisional application No. 60/961,314, filed on Jul. 20, 2007.

(51) Int. Cl.
*A45D 19/16* (2006.01)

(52) U.S. Cl. ..... 132/272

(58) Field of Classification Search ..... 132/271, 132/272, 221, 227, 233, 112–16, 118, 228; 34/96–98; 401/1, 2, 263, 261, 196, 198; 222/187

See application file for complete search history.

(56) References Cited

U.S. PATENT DOCUMENTS

| | | | | |
|---|---|---|---|---|
| 1,546,638 | A * | 7/1925 | Evans | 132/114 |
| 4,376,441 | A * | 3/1983 | Duncan | 132/272 |
| 4,913,172 | A * | 4/1990 | Chou | 132/118 |
| 5,241,974 | A * | 9/1993 | Tsai | 132/272 |
| 5,275,339 | A * | 1/1994 | Andis et al. | 239/443 |
| 5,572,800 | A * | 11/1996 | West | 34/97 |
| 5,584,307 | A * | 12/1996 | Bauer et al. | 132/113 |
| 5,761,824 | A * | 6/1998 | Moon et al. | 34/97 |
| 5,845,656 | A * | 12/1998 | Assmann | 132/271 |
| 6,089,239 | A * | 7/2000 | Ehlhardt et al. | 34/97 |
| 6,775,922 | B2 | 8/2004 | Langley et al. | |
| 2005/0198854 | A1 * | 9/2005 | Hobe | 34/96 |

* cited by examiner

*Primary Examiner* — Todd Manahan
*Assistant Examiner* — Brianne Kalach
(74) *Attorney, Agent, or Firm* — Greer, Burns & Crain, Ltd.

(57) ABSTRACT

An integrated hair drying and hair treatment system is provided, including an attachment for a heated hair styling device, including a supply of hair conditioner disposed on the attachment so that the conditioner is dispensed upon said attachment contacting the hair.

10 Claims, 9 Drawing Sheets

CONDITIONER APPLICATOR FOR HAIR STYLING DEVICE

The present application claims priority under 35 USC §119 (e) from U.S. Ser. No. 60/961,314.

BACKGROUND OF THE INVENTION

The present invention relates generally to powered hair styling devices, and more particularly to attachments for such devices used for assisting the cutting or styling process.

Hair styling devices include powered clippers and trimmers, as well as hair dryers, straighteners, curling irons, hot air brushes, curlers and the like. As is well known in the art, each such device is used for a particular part of the hair styling process. In many cases, attachments are provided for hair styling devices. In the case of hair clippers and trimmers, attachment combs are provided for maintaining the length of cut hair. In the case of hair dryers, attachments are employed for more evenly distributing heat without damaging the hair or scalp.

Diffusers, concentrators, and finger pics are types of hair dryer attachments added to the output end or barrel of a hair dryer. Finger pics, or attachments for hair dryers with finger like projections, have been used for many years. A finger pic allows the user to pick up their hair during the drying process to speed up drying as well as to add body by fluffing the hair. Exemplary hair dryer attachments are disclosed in commonly-assigned U.S. Pat. No. 6,775,922 which is incorporated by reference.

Hair dryers used daily create heated airflow that removes vitality from a user's hair. Due to this heat and the typical associated brushing and combing used in the drying process, hair becomes brittle, loses its natural oils and shine, split ends develop, as well as other negative hair degrading qualities. A user typically relies upon separate liquid or gel hair additives, including but not limited to moisturizers, vitamins, silicones, oils, herbs, minerals, proteins, fragrances, panthenol, quaternaries, color and the like, collectively referred to here as "conditioners", that are used upon drying completion or during the drying process. Conditioners are commonly accepted as providing a way for maintaining hair natural and shiny, protecting against other chemicals and holding type products, and for making hair healthier.

This need to repair hair damage done by hair dryers, as well as enhancement to one's hair beauty has resulted in a multi-billion dollar hair supplement business. During the styling process, the user typically applies a dose of conditioner to the hands, rubs the hands together, and then runs the hands through the hair prior to or after drying. The user then needs to wash and dry the hands prior to further drying or other styling. This required procedure adds significant time to the styling process.

The addition of moisture or fragrance to the airflow of a hair dryer has been known for years as well. Moisture has been added to dryers via mechanical means and fragrance has been added via quite a few different methods. Typically, moisture has always been carried via the airstream only. One drawback of such devices is that the conditioner is not uniformly distributed on the hair. Another drawback is that much of the conditioner is wasted in the dryer airflow, thus being unavailable for use by the stylist.

Thus, there is a need for an improved hair styling attachment that more efficiently uses hair conditioners. There is also a need for an improved hair styling attachment enabling the user to obtain greater control over the placement and the amount of hair conditioner applied to the hair. Still another need is for a hair styling device which reduces the time required in the hair styling process.

BRIEF SUMMARY OF THE INVENTION

The above-listed needs are met or exceeded by the present hair styling attachment and associated conditioner applicator, which more completely integrates the hair conditioner into the hair styling process. With the present attachment, the hair conditioner is easily added to the hair before drying is completed, thus reducing damage to hair by the drying process. In addition, the present hair styling attachment reduces the time required for hair styling.

An important feature of the present device is that the conditioner is applied to the hair by direct contact in a solid or liquid state as the styling device is passed through the hair, such as by brushing combing or stroking through the hair being styled. By providing direct contact between the conditioner and the hair, the conditioner is more efficiently applied where desired without waste. Also, the user maintains more accurate control over the amount of conditioner applied. Since the conditioner does not have to be directly handled, the user can more efficiently manipulate the dryer or other styling device, saving styling time. In a preferred embodiment, the conditioner is provided in a replaceable strip or cartridge. Multiple cartridges can be provided, each having a distinct conditioner product.

In another embodiment, the conditioner cartridge is movable in the styling device between an activated position for directly applying the conditioner to the hair, an indirect position for placing conditioner in the air stream, and a storage position where the conditioner is not available for styling. The conditioner cartridge is installable in a variety of attachments, including those used on hair dryers, hair straighteners, curling irons, styling irons, and the like. Dryer attachments include pics, diffusers and barrel extensions. Also, the conditioner is provided in a formulation which is easily loaded into the attachment prior to use in a solid or inactive state, but when exposed to the relatively higher temperatures of the styling device, the conditioner softens and becomes activated, and is more available to the hair.

The conditioner may be provided in gel format, or as a liquid, it may be provided in a wick in fluid communication with a stored volume of conditioner, and it may be biased against the hair as by a spring force.

DETAILED DESCRIPTION OF THE INVENTION

Figure 1:
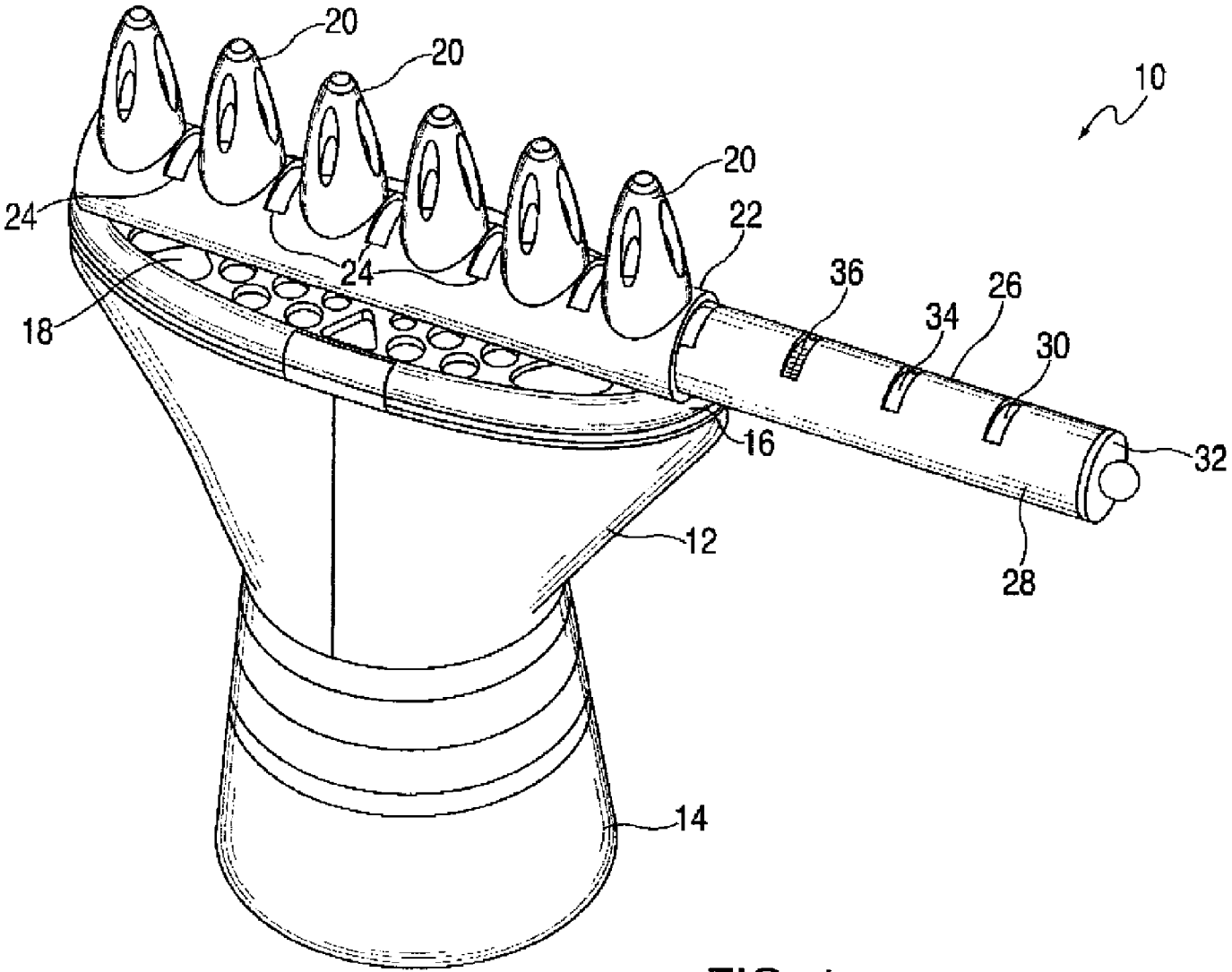
FIG. 1 is a top perspective view of a hair dryer attachment incorporating the present conditioner applicator, shown with a conditioner cartridge being inserted.

Referring now to FIG. 1, a hair styling attachment is generally designated 10, and is depicted as a hair dryer attachment. However, other attachments are contemplated, including those used for other hair styling devices, including but not limited to hair clippers and trimmers, hair straighteners, curling irons, styling irons, heated hair brushes and the like. The attachment 10 has a housing 12 with an attachment end 14 configured for fastening the attachment to the hair styling device using friction or other fastening technologies as is known in the art. Opposite the attachment end 14 is an outlet end 16 having at least one outlet opening 18 through which air passes from the dryer to the user's hair. The number, shape and arrangement of the openings 18 can vary widely with the configuration of the attachment, and examples of such attachments are provided in U.S. Pat. No. 6,775,922 which is incorporated by reference.

In the attachment 10 in FIG. 1, the outlet end 16 is further provided with a plurality of pic fingers 20 which are secured to a conditioner chamber 22 having at least one and preferably a plurality of conditioner apertures 24. The conditioner chamber 22 is constructed and arranged for slidably and releasably receiving a conditioner cartridge 26. Major components of the cartridge 26 are a carrier or support element 28, a conditioner active ingredient element 30 and a user-actuated handle 32. The carrier element 28 can assume many forms, as long as it supports the active ingredient 30 for releasable insertion into the chamber 22. It is contemplated that the active ingredient element 30 is a conditioner as defined above and is provided in a gel or relatively solid state. Upon exposure to the heated air generated by the dryer, the gel turns to liquid which flows from conditioner ports 34, through the conditioner apertures 24 and is placed in direct contact in solid or liquid state with the hair. Alternatively, active ingredient element 30 is provided in a liquid state, and a wicking element 36 is placed in the conditioner ports 34 to regulate the flow of conditioner through the ports 34. Even as a liquid, the conditioner 30 is still placed in direct contact with the hair.

Figure 2:
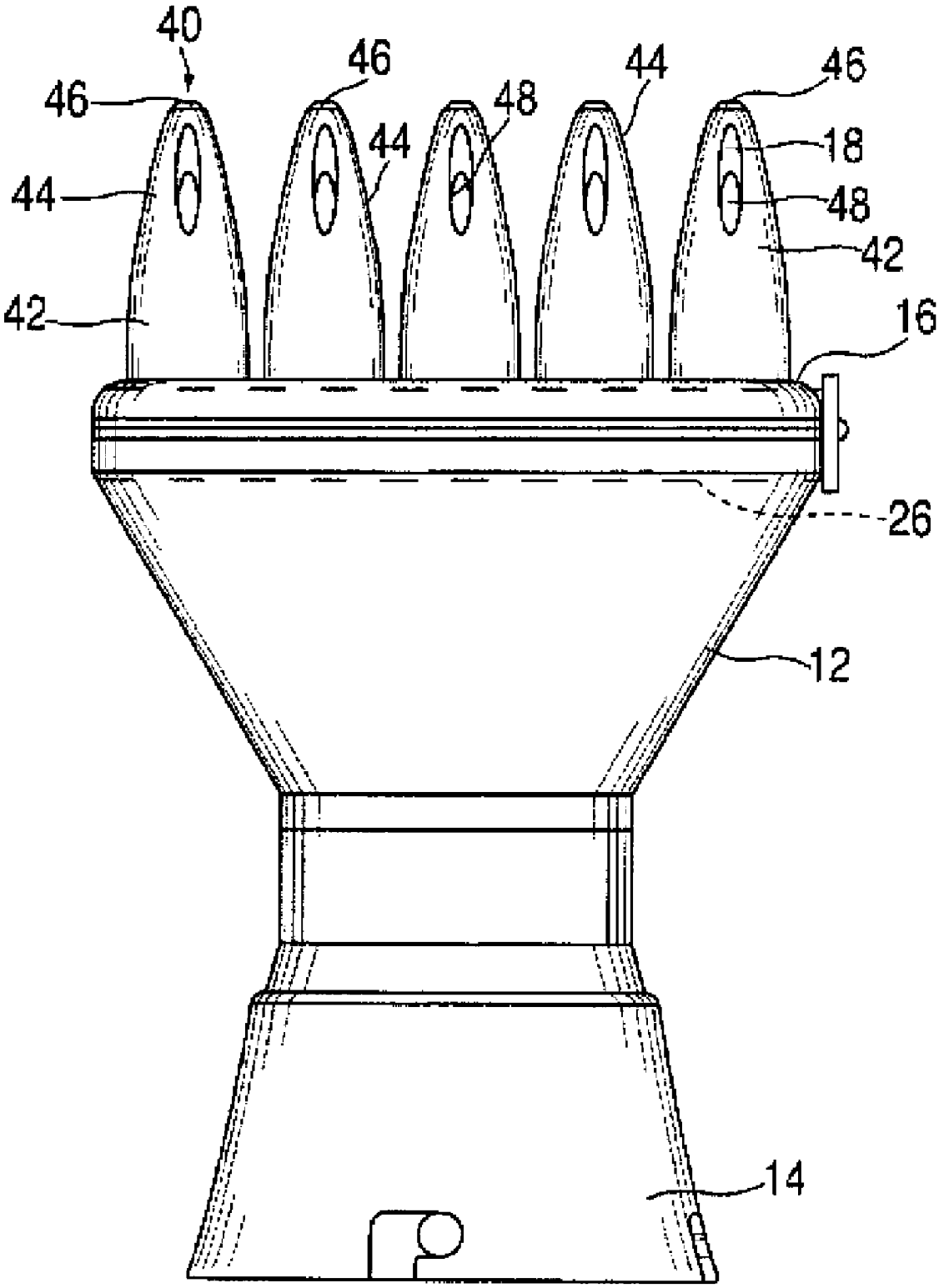
FIG. 2 is a perspective view of an alternate attachment incorporating the present conditioner applicator which applies the conditioner through the pic fingers.

Referring now to FIG. 2, an alternate embodiment of the attachment 10 is generally designated 40. Components shared with the attachment 10 are designated with identical reference numbers. A main distinction of the attachment 40 is that the conditioner cartridge 26 is located within the housing 12, and the fingers 42 are provided with outer covers 44 of resilient, rubber-like material such as silicone and have finger outlets 46 at tips of the covers 44 through which the liquid active ingredient element 30 or conditioner flows from the cartridge 26 to directly contact the hair. Cores 48 of the fingers are made of more rigid material such as harder plastic to provide structural support for the fingers. In the attachment 40, the cartridge 26 is thus in fluid communication with the outlets 46 through hollow interiors of the fingers. As such, the conditioner apertures 24 are omitted.

Referring now to FIGS. 3-6, another alternate embodiment to the present attachment 10 is generally designated 50. Components shared with the attachments 10 and 40 are designated with identical reference numbers. In the attachment, 50, a conditioner chamber 52 is located at the outlet end 16 between opposed rows of pic fingers 54. A cartridge 56 is axially rotatable in the chamber 52, and is configured so that depending on the amount of rotation, the amount of active ingredient 30 applied to the hair can be varied. The cartridge 56 is received in the chamber 52 by a keyed arrangement whereby the cartridge is rotatable in the chamber but cannot be removed without overcoming the key, as by an axial push and rotation, of the type known in the art.

Figure 3:
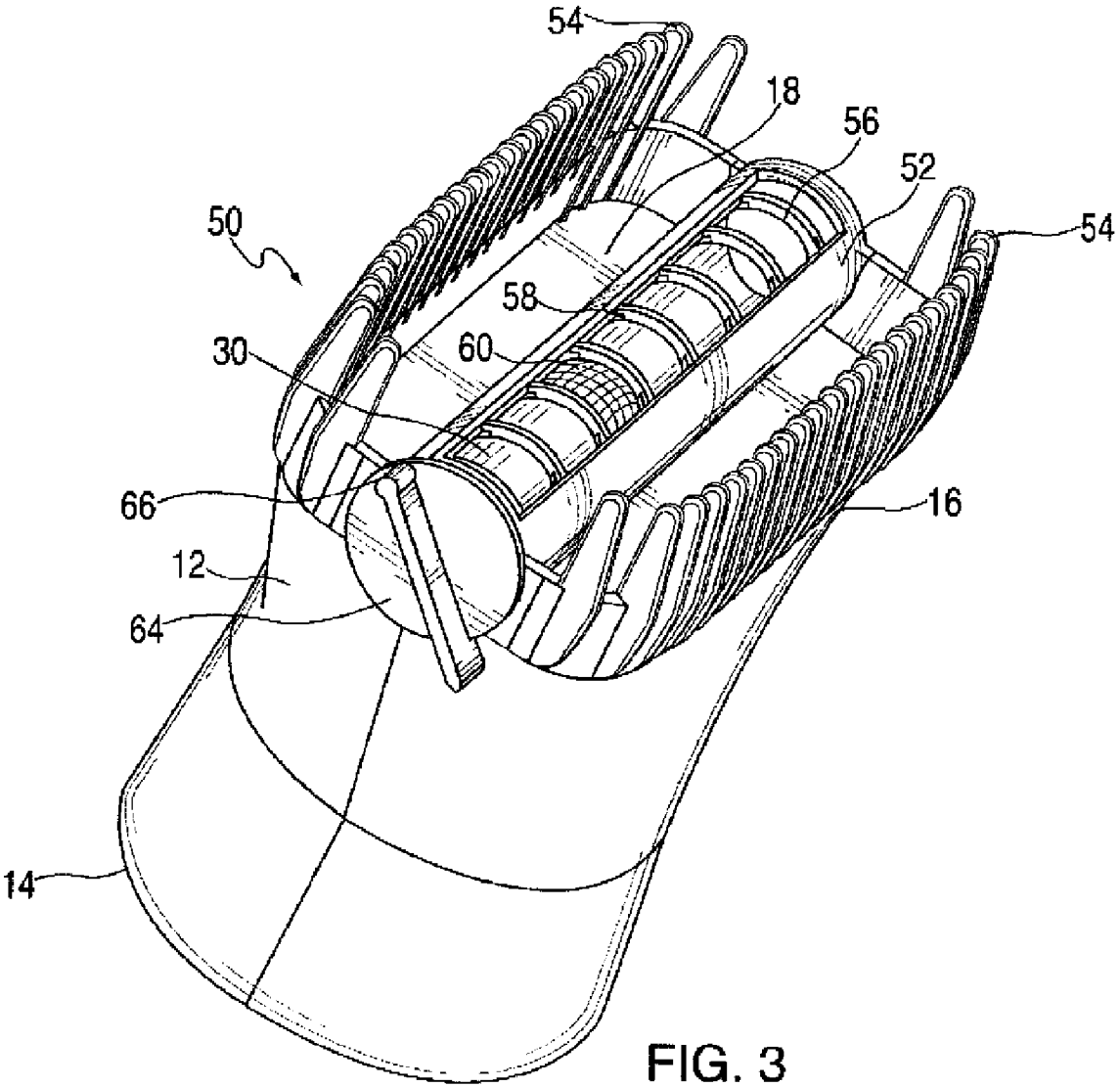
FIG. 3 is a top perspective view of another embodiment of the present conditioner applicator associated with a dryer attachment and shown in a contact applicating position.

Also, the cartridge 56 has an applicating side 58 with direct contact to the conditioner 30 in a gel state, or to a wicking media cover 60 when the conditioner 30 is in a liquid state (FIG. 3). Prior to use, the cartridge 56 is optionally provided with a protective peel off strip (not shown) to retain the conditioner 30 within the cartridge. In the latter situation, the conditioner is retained in the cartridge 56 behind the cover 60, but passes through upon being exposed to the heated dryer air. Such covers 60 may also be used when the conditioner 30 is provided in a gel state.

Opposite the applicating side 58 is a blocked side 62 which, when rotated to be in alignment with the outlet (FIG. 6), prevents contact of between the hair and the conditioner 30. A handle 64 is provided to the cartridge 56 having an indicator 66 to facilitate the user appropriately orienting the cartridge with the desired amount of conditioner to be dispensed.

Figure 4:
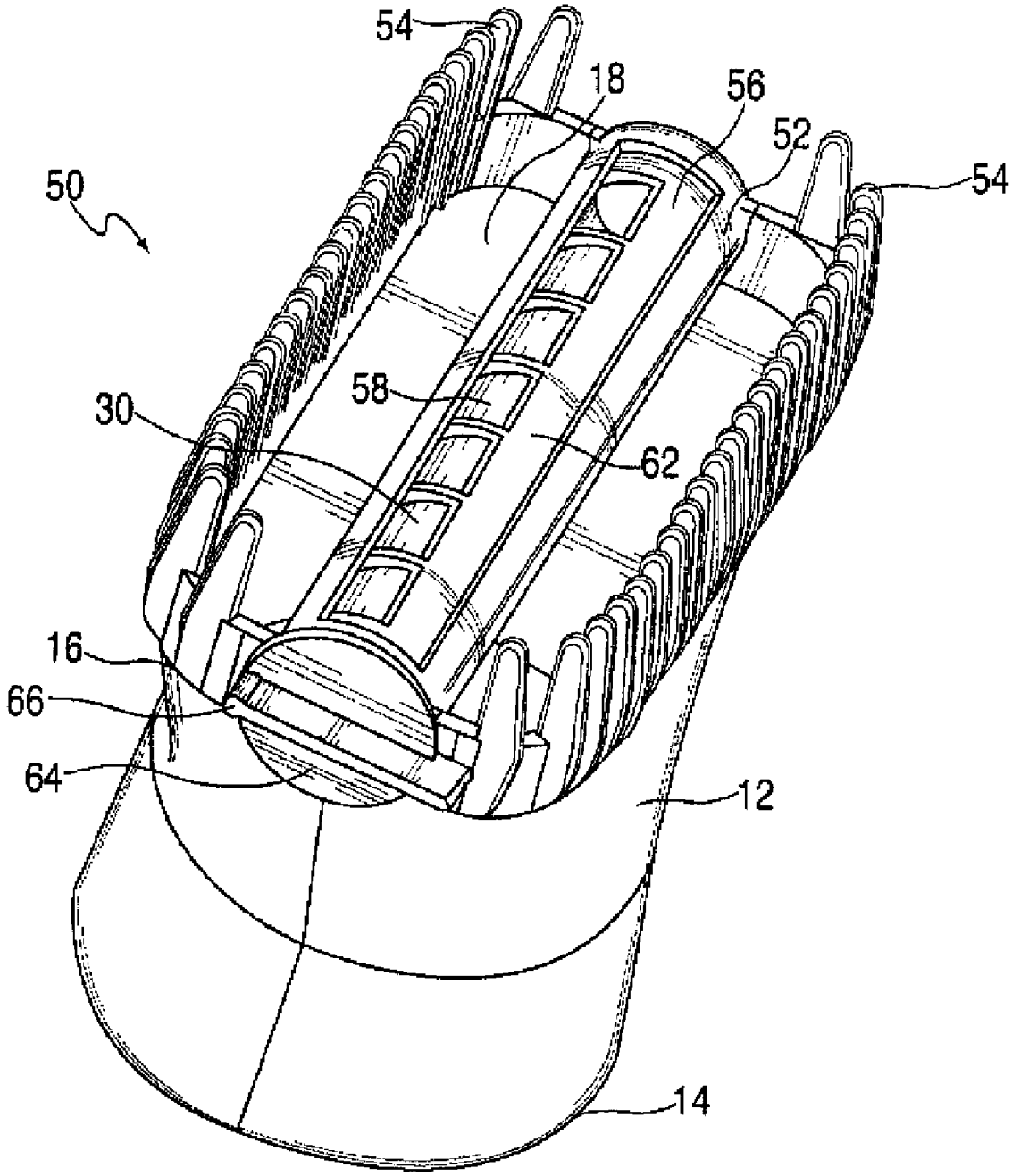
FIG. 4 is a top perspective of the attachment of FIG. 3 shown in mid position between an applicating and a blocking position.
Figure 5:
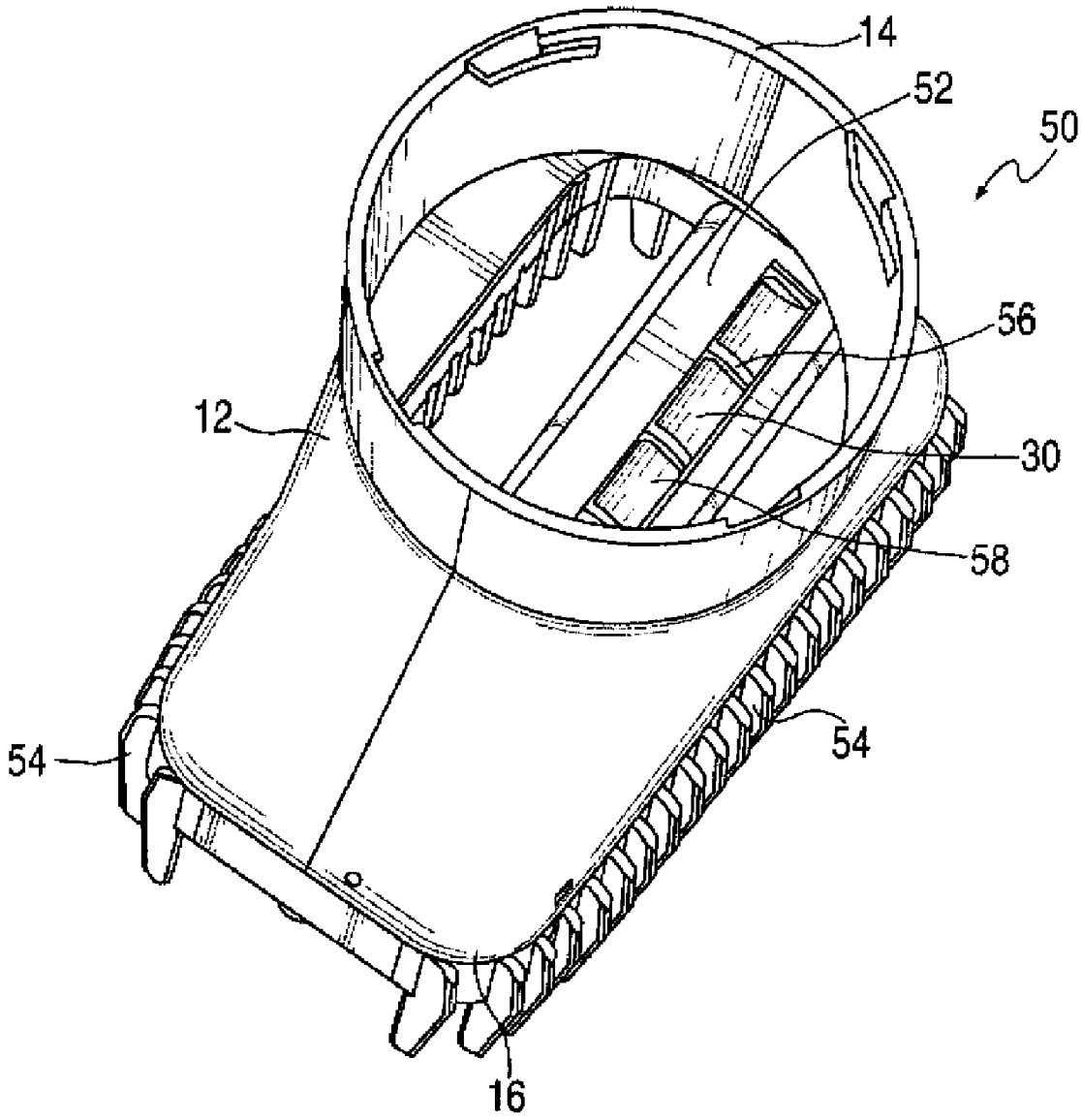
FIG. 5 is a bottom perspective view showing the attachment of FIG. 3 in the indirect position.
Figure 6:
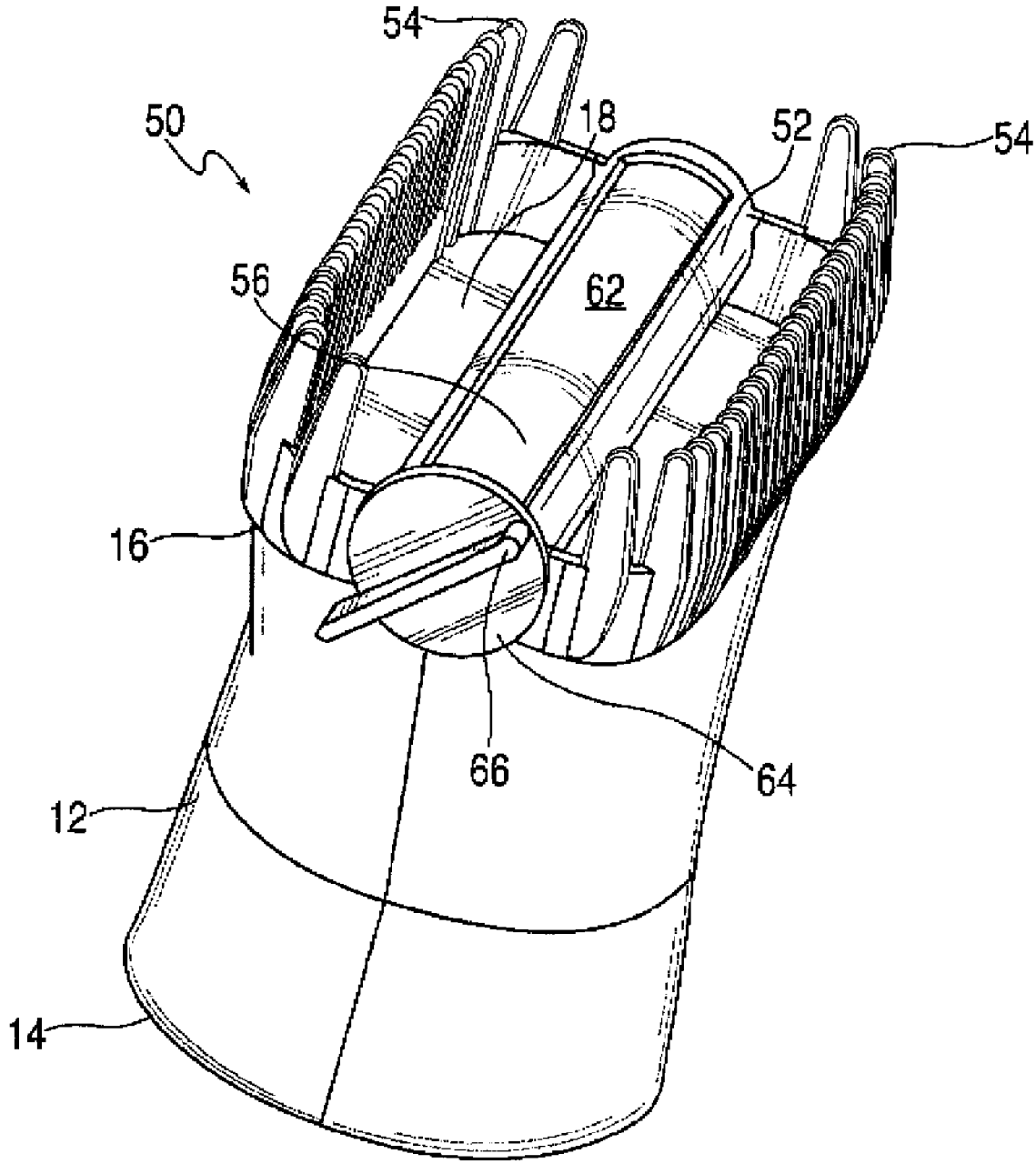
FIG. 6 is a reverse perspective of the attachment of FIG. 3 shown in the blocked position.

Referring now to FIG. 4, the cartridge 56 is shown in a partially blocked orientation, which results in a reduced amount of conditioner 30 being available compared to the orientation depicted in FIG. 3. Turning now to FIG. 5, once the cartridge 56 is rotated approximately 180° from the position shown in FIG. 3, the applicating side 58 faces the attachment end 14, which is also the air inlet from the dryer. In this position, the conditioner will be applied to the hair in a more conventional manner, in that the flowing hot air will collect particulate or droplets of the conditioner for transmission in the airflow toward the hair. Thus, in that orientation, no contact between the attachment and the hair will cause application of conditioner.

Figure 7:
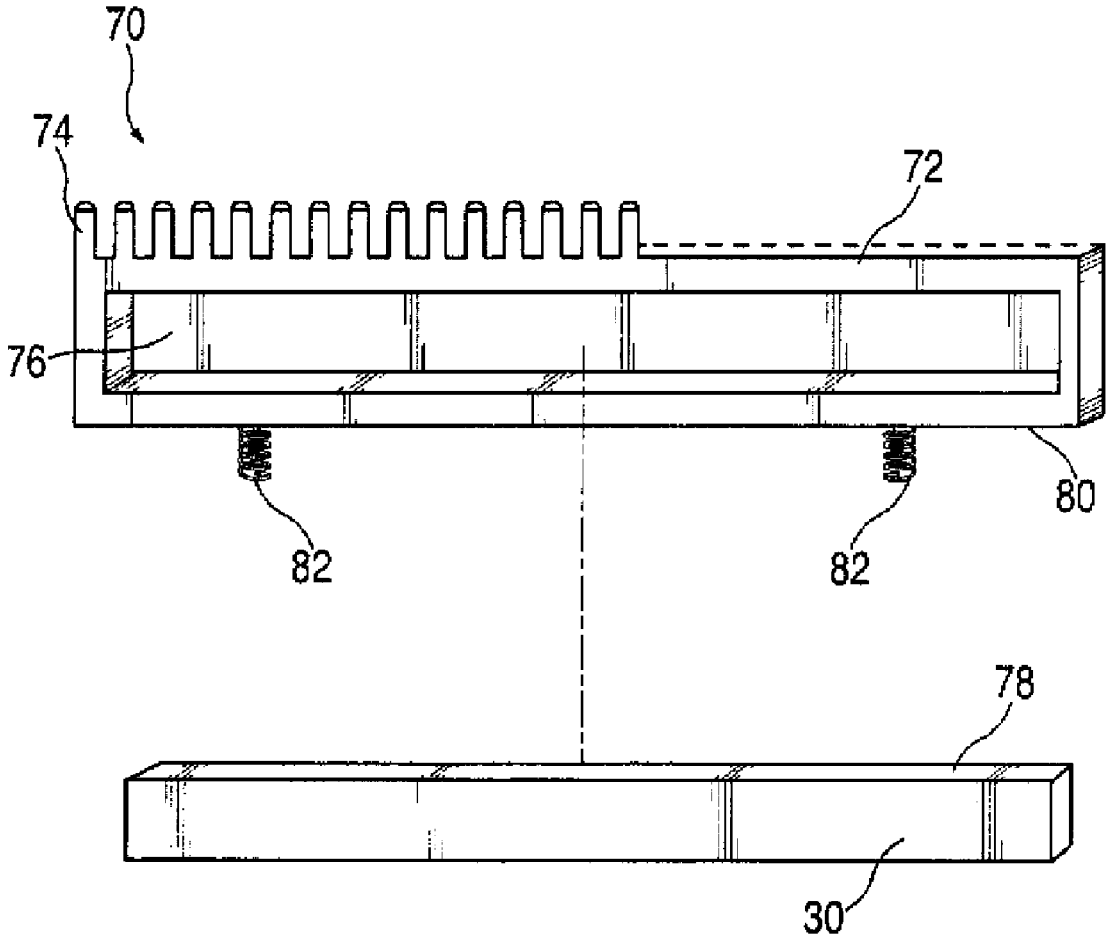
FIG. 7 is an elevational view of a comb attachment for a hair straightener equipped with an embodiment of the present conditioner applicator.

Referring now to FIG. 7, an alternate embodiment of the present attachment is generally designated 70. The attachment 70 is intended for use in a straightener, curling iron, styling iron or the like. A housing 72 is constructed and arranged for being releasably engaged in one of the pivoting arms of the straightener or iron. Most preferred is location on a heated arm. The attachment 70 is configured as a removable comb with a row of teeth 74 (partially shown) through which the hair can flow. A cartridge chamber 76 is defined in the housing 72 and receives a cartridge 78 so that the conditioner 30 is exposed to the hair through an open end 80. In the preferred embodiment, the attachment 70 is spring loaded through biasing force provided by at least one spring 82. The springs 82 urge the attachment 70 and the conditioner 30 against a resisting force generated by the hair as the attachment is passed through the hair.

Figure 8:
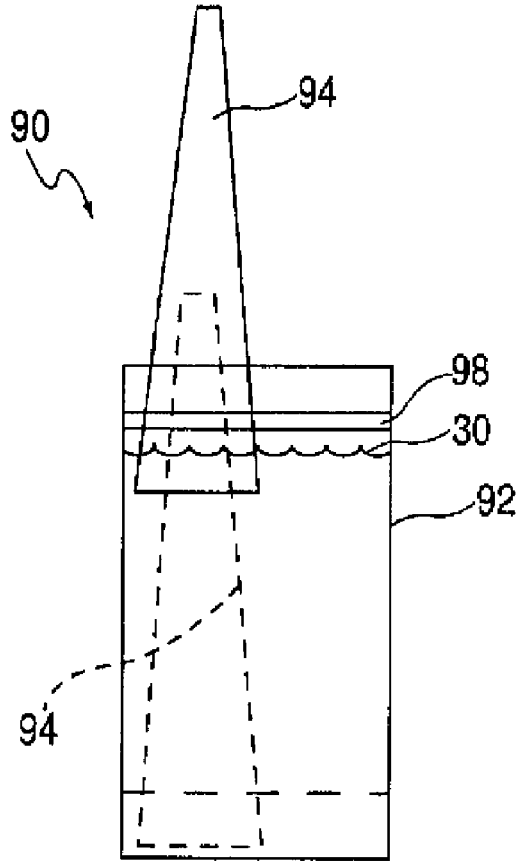
FIG. 8 is a schematic side view of an alternate embodiment of the comb attachment of FIG. 7 shown with a wicking applicator.

Referring now to FIG. 8, an alternate embodiment of the attachment 70 is generally designated 90. A housing 92 retains a supply of conditioner 30, preferably in liquid form, and a wicking applicator 94 is disposed to project from the housing to contact the hair, but is also partially immersed in a conditioner chamber 96. The wicking applicator 94 is made of an absorbent material, and is also sufficiently rigid to maintain its structure when passed through the hair. A preferably wicking material is TEFLON® fluoropolymer, however industrial felts or materials promoting capillary action are also considered suitable. A seal 98 prevents the leakage of conditioner 30 from the chamber 96. As the level of conditioner 30 falls within the chamber 96 (shown in phantom), the applicator 94 moves with the conditioner, but is sufficiently long to project from the attachment housing 72 to contact the hair.

Figure 9:
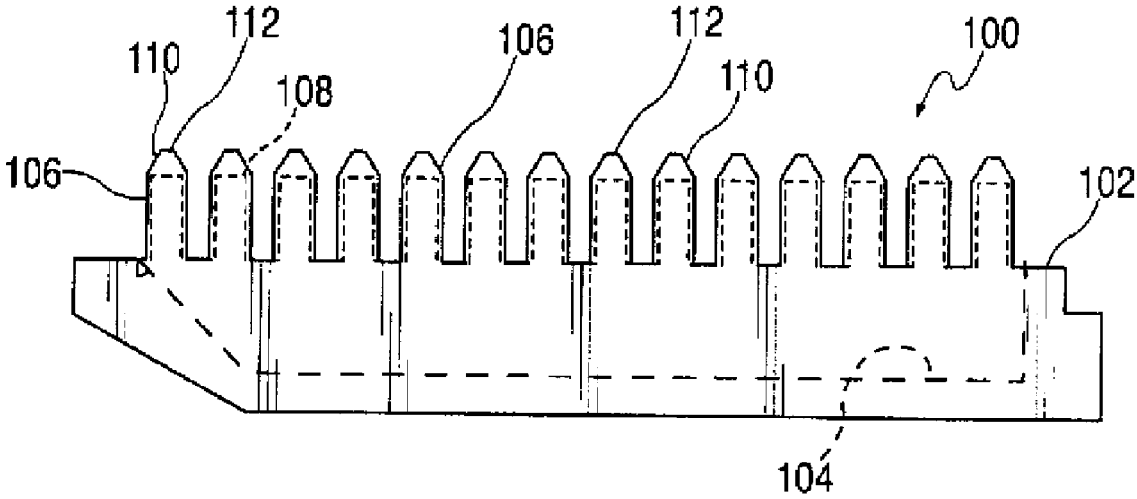
FIG. 9 is another alternate embodiment of the comb attachment of FIG. 7 with comb teeth configured to be the conditioner applicators.

Referring now to FIG. 9, another alternate embodiment of the attachment of FIG. 7 is generally designated 100. As is the case with the attachments, 70 and 90, the attachment 100 is intended for use with a straightener, curling iron, styling iron or the like. An attachment housing 102 defines a conditioner chamber 104, here designed for storing the conditioner in a liquid state. The chamber 104 is in fluid communication with a plurality of teeth 106 which have relatively rigid, tubular cores 108 and relatively resilient, rubber-like or silicone covers 110 with openings 112 at the tips. Conditioner 30 in liquid form migrates from the chamber 104 into the resilient covers 110 and eventually through the openings 112 to directly contact the hair.

Figure 10:
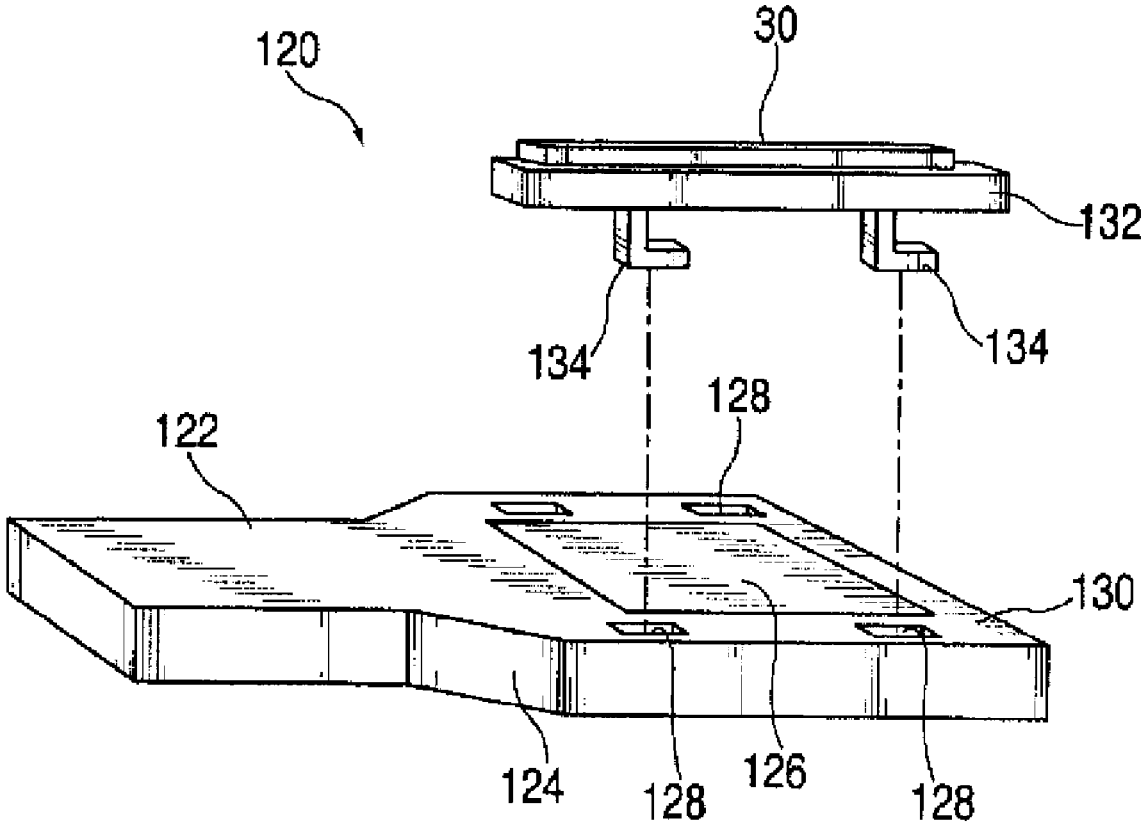
FIG. 10 is an exploded perspective view of a hair straightener with an associated conditioner attachment.

Referring now to FIG. 10, another alternate embodiment of the attachment of FIG. 7 is generally designated 120 and is intended for use with a hair straightener 122 having at least one arm 124 with a heated straightener plate 126. In this embodiment, the attachment 120 takes the form of a cartridge as described above in relation to FIGS. 1-7. At least one and preferably a plurality of attachment points 128, here sockets are provided on a surface 130 of the arm 124. The attachment 120 includes a housing 132, here an elongate planar support member dimensioned to lie adjacent the straightener plate and provided with a gel-like conditioner 30 in a relatively thin plate format. Depending from the housing is at least one and preferably a plurality of latch members 134, preferably corresponding in number to the attachment points 128 and configured to be received therein in a releasable locking relationship. The manner in which the locking relationship is obtained may vary to suit the situation. As the hair is straightened and subjected to heat from the heated straightener plate 126, the conditioner 30 is also activated by the heat and directly contacts the hair, preventing damage from exposure to the straightener plate. As described above in relation to the attachments 70, 90 and 100, the attachment 120 is optionally provided with teeth.

In summary, the present hair styling device attachment system features a dryer attachment such as a finger style hair pic, roller, diffuser or concentrator which the user can selectively attach to their dryer during or after the hair drying process. The attachment has a user insertable cartridge which contains a hair-enhancing liquid or gel material such as but not limited to Vitamin E, Vitamin C, silicone, fragrance, panthenol, quaternaries, color, and hair oils. Styles of cartridges with specific hair enhancement purposes can be made available. The insertable cartridge has a containment vessel and an applicating end or contact strip or equivalent structure for delivering the liquid from the vessel to the outside. The contact strip is in fluid communication with the reservoir of the containment vessel, and the contact strip is able to wick the hair enhancing material. By selective mechanical location of the cartridge in the dryer attachment, the user can chose to keep the insertable cartridge out of the hair dryer airstream or expose the contact strip to the dryer's airstream to transfer to the airflow fragrance and hair enhancing materials, or to make direct contact with the user's hair as it travels within the attachment such as fingers of the hair pic, diffuser or stems of a roller brush or concentrator. Another advantage of the present applicator is that it reduces clutter at the stylist workstation or in the user's bathroom; in the hair drying and styling are performed in a single operation with a single device.

While specific embodiments of the conditioner applicator for a hair styling device of the present invention have been shown and described, it will be appreciated by those skilled in the art that changes and modifications may be made thereto without departing from the invention in its broader aspects and as set forth in the following claims.

What is claimed is:

1. An attachment for a heated hair styling device, comprising a supply of hair conditioner disposed on said attachment so that the conditioner is dispensed directly to the hair upon said attachment contacting the hair, said attachment includes at least one outlet and a plurality of teeth projecting in a direction of air flow from said attachment adjacent said at least one outlet, and the conditioner is provided as a cartridge including an active ingredient portion in a solid state and a carrier portion, said conditioner is dispensed as a flowing liquid from said active ingredient portion at said at least one outlet to be in direct contact with the hair as said attachment directly contacts the hair, said attachment having a housing configured for orienting said cartridge so that a longitudinal axis of said cartridge is transverse to said direction of projection of said teeth and for rotatably receiving said conditioner cartridge, and said cartridge being movable through user manipulation of said cartridge about said longitudinal axis at least between a storage and a dispensing position, in said dispensing position, said conditioner cartridge constructed and arranged to dispense said conditioner separately from said plurality of teeth.

2. The attachment of claim 1 wherein the supply of conditioner is releasably secured to the attachment.

3. The attachment of claim 2 further including a plurality of conditioner cartridges each insertable into the attachment and each having a distinct conditioner product.

4. The attachment of claim 1 wherein said conditioner being activated upon sufficient heat being generated by the styling device.

5. The attachment of claim 1 wherein said conditioner cartridge is movable between the storage position, a direct dispensing position and an indirect dispensing position.

6. The attachment of claim 1 wherein the conditioner is taken from the group consisting of moisturizers, vitamins, silicones, oils, herbs, minerals, proteins, fragrances, panthenol, quaternaries and hair color.

7. An attachment for a heated hair styling device, comprising:

a supply of hair conditioner disposed on the attachment so that the conditioner is dispensed directly to the hair upon said attachment contacting the hair;

said attachment including a housing having at least one outlet and a plurality of teeth projecting from said housing adjacent said outlet;

said conditioner being provided in a cartridge including an active ingredient portion and a carrier portion, said active ingredient portion is provided in a liquefiable state, and being activated upon sufficient heat being generated by the styling device, said active ingredient portion being releasably secured to said carrier portion, said conditioner is dispensed from said active ingredient portion through said at least one outlet to be in direct contact with the hair as said attachment directly contacts the hair, said carrier portion defining a longitudinal axis; and said housing being configured for rotatably receiving said conditioner cartridge such that said cartridge is oriented along said longitudinal axis and is transverse to said at least one outlet and being axially rotatable about said longitudinal axis through user manipulation of said cartridge at least between a storage position, a direct dispensing position and an indirect dispensing position, in said dispensing positions, said cartridge dispenses said conditioner separately from said teeth.

8. The attachment of claim 7 wherein the conditioner is taken from the group consisting of moisturizers, vitamins, silicones, oils, herbs, minerals, proteins, fragrances, panthenol, quaternaries and hair color.

9. The attachment of claim 7 wherein said plurality of teeth are aligned in at least one elongate row, and said cartridge is aligned in spaced, parallel orientation to said at least one row of said teeth.

10. The attachment of claim 9 further including a spaced pair of rows of said teeth, and said cartridge is disposed between said rows.

* * * * *